United States Patent [19]

Landry

[11] 4,349,790

[45] Sep. 14, 1982

[54] COAX TO RECTANGULAR WAVEGUIDE COUPLER

[75] Inventor: Norman R. Landry, Mount Laurel, N.J.

[73] Assignee: RCA Corporation, New York, N.Y.

[21] Appl. No.: 255,282

[22] Filed: Apr. 17, 1981

[51] Int. Cl.[3] ..... H01P 1/195; H01P 5/103

[52] U.S. Cl. ..... 333/24.1; 333/26; 333/33

[58] Field of Search ..... 333/21 R, 26, 33, 24.1

[56] References Cited

U.S. PATENT DOCUMENTS

| | | | |
|---|---|---|---|
| 3,076,180 | 1/1963 | Havens et al. | |
| 3,109,996 | 11/1963 | Allen | 333/21 R |
| 3,116,467 | 12/1963 | Damon . | |
| 3,425,001 | 1/1969 | Hershenov . | |
| 3,555,460 | 1/1971 | Landry . | |
| 3,573,835 | 4/1971 | Stark et al. | |
| 3,698,000 | 10/1972 | Landry et al. | |
| 3,758,886 | 9/1973 | Landry et al. | |
| 3,760,305 | 9/1973 | Mason et al. | |
| 3,768,040 | 10/1973 | Mason et al. | |
| 3,972,013 | 7/1976 | Shapiro . | |
| 3,973,225 | 8/1976 | Hines | 333/24.1 |

OTHER PUBLICATIONS

Young, "Assembly for Positioning the Coupling Probe of a Waveguide," U.S. Pat. Appl. Ser. No. 152,307, filed 5/22/80.

*Primary Examiner*—Paul L. Gensler

*Attorney, Agent, or Firm*—Samuel Cohen; Robert L. Troike; Robert Ochis

[57] ABSTRACT

A coaxial transmission line is coupled to a dielectrically loaded rectangular waveguide by an E-plane probe which extends through a broad wall of the waveguide and into a slot in the body of loading dielectric. The slot and probe are positioned substantially laterally off-center in the body of dielectric material.

7 Claims, 5 Drawing Figures

COAX TO RECTANGULAR WAVEGUIDE COUPLER

Figure 1:
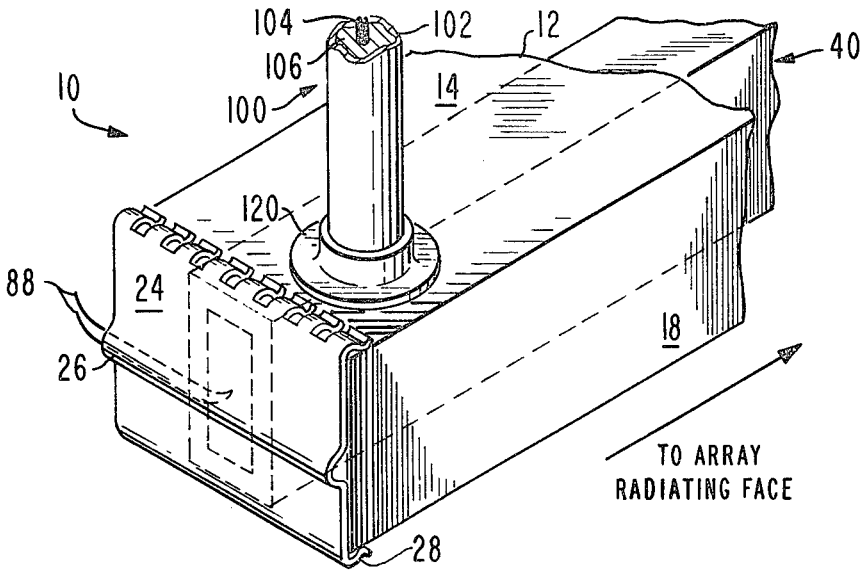

This invention relates to the field of microwave coupling structures and, more particularly, to the field of coupling structures for connecting a coaxial transmission line to a dielectrically loaded waveguide for the purpose of transmitting all of the power propagating in one to the other.

There are many situations in which it is desirable to electrically couple a coaxial transmission line to a dielectrically loaded rectangular waveguide to transmit all of the power propagating in one to the other. One place where this is particularly desirable is in large phased array antenna systems where coaxial transmission lines and gyromagnetic material loaded waveguide phase shifters, for example, are used for different, electrically adjacent, parts of the antenna feed network. Gyromagnetic material is a general term intended to encompass ferrimagnetic materials, ferromagnetic materials and any other material which exhibits magnetic hysteresis and specifically includes ferrites and garnets of the types commonly utilized in waveguide phase shifters. Fired, ceramic, gyromagnetic materials are used in these phase shifters to obtain low microwave losses. These gyromagnetic materials are generally hard and brittle and have relatively high dielectric constants. Gyromagnetic waveguide phase shifters are coupled to the antenna radiators and control the introduction of selected phase shifts in the signals coupled to the different radiators for the purpose of beam formation and steering.

One particular type of gyromagnetic waveguide phase shifter (see U.S. Pat. Nos. 3,760,305 and 3,768,040 to Mason et al., U.S. Pat. No. 3,698,000 to Landry et al. and U.S. Pat. No. 3,555,460 to Landry, all incorporated herein by reference) employs a toroid of gyromagnetic material for controlling phase shift and utilizes fired ceramic inserts to substantially fill the hollow of the toroid to obtain desired waveguide loading. Control wires extend longitudinally through the hollow of the toroid. When it is desired to change the phase introduced by a phase shifter, drive currents are carried by the control wires in order to set the remanence of the gyromagnetic material to a value which induces the desired phase shift.

An unloaded waveguide is similar to a dielectrically filled waveguide because the dielectric constant is the same everywhere in the waveguide. It is known that one way to couple a coaxial transmission line to this type of waveguide is by orienting the coaxial transmission line perpendicular to one of the broad walls of the waveguide. A waveguide probe extends from the end of the coaxial transmission line (in axial alignment therewith) through an aperture in the waveguide broad wall into the interior of the waveguide. Probes of this type are normally centered side-to-side between the narrow walls of the waveguide $\frac{1}{4}$ wavelength from a short circuit termination of the waveguide in order to position the probe in the region of maximum E-field. In this manner effective coupling (i.e., near 100% power transmission) is provided between a coaxial transmission line and an unloaded or dielectrically filled waveguide where the transmission line is oriented perpendicular to the broadwalls of the waveguide. These transitions are known as E-plane transitions.

Drilling of the ceramic gyromagnetic toroid and ceramic core in a gyromagnetic waveguide phase shifter after toroid assembly in difficult because of the extreme hardness and brittleness of the fired gyromagnetic and core ceramics and is extremely tenuous because the control wires must be protected from breakage or other impairment. Such drilling, especially of small diameter holes, requires the use of a grit slurry and an ultrasonically vibrated (steel) drill and takes about 20 to 30 minutes to obtain a depth of 0.55 inch (1.4 cm). Consequently, this is not an acceptable manufacturing procedure where large quantities of phase shifters are used, as in large phased array antennas. In consequence, E-plane coaxial-transmission-line-to-waveguide coupling structures of the type employing an E-plane waveguide probe centered between the narrow walls of the waveguide have been impractical for use with gyromagnetic phase shifters of this type.

In the past, coaxial transmission lines have been coupled to dielectrically loaded waveguides utilizing end launch couplers in which a waveguide probe extends through an end of the waveguide in axial alignment with both the waveguide and the coaxial transmission line. Such couplers typically utilize initial transformer stages in the vicinity of the probe-to-waveguide transition to match the coaxial transmission line to the waveguide, for an example of such a structure see U.S. Pat. No. 3,758,886 to Landry et al. This patent is incorporated herein by reference. However, such couplers do not provide space-efficient coupling between a coaxial transmission line structure and a perpendicularly oriented waveguide structure because of the need for the end launch transformer sections and the required in-line-with-the-waveguide orientation of at least the end portion of the coaxial structure.

An E-plane coupler is needed which is both electrically efficient and mechanically compact while allowing the end portion of the coaxial transmission line structure to be oriented perpendicular to the waveguide.

In accordance with one preferred embodiment of the present invention, the problems of the prior art are overcome by orienting a coaxial transmission line perpendicular to a broad wall of a dielectrically loaded rectangular waveguide. The loading body of dielectric material has a dielectric constant which is relatively high compared to that of air and occupies less than the full width of the waveguide. The transmission line terminates in an E-plane waveguide probe which is positioned significantly laterally off-center in the dielectric body in a slot extending into its lateral surface.

Figure 2:
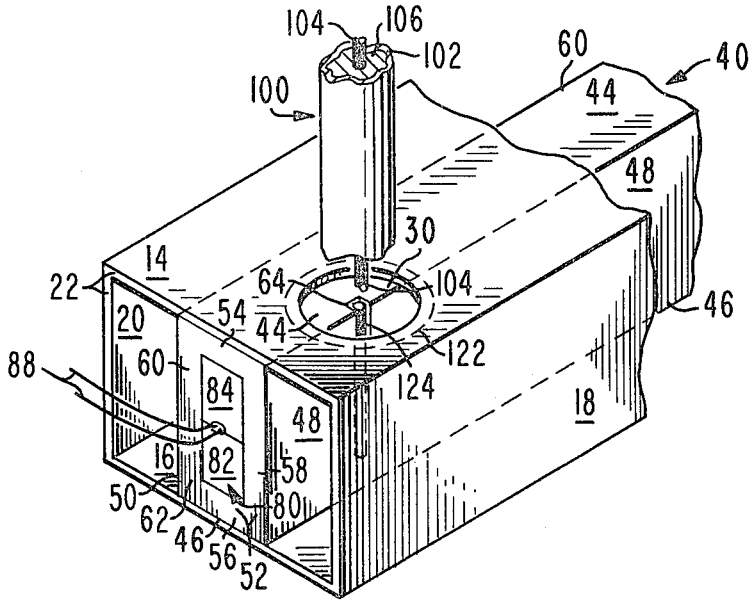
Figure 3:
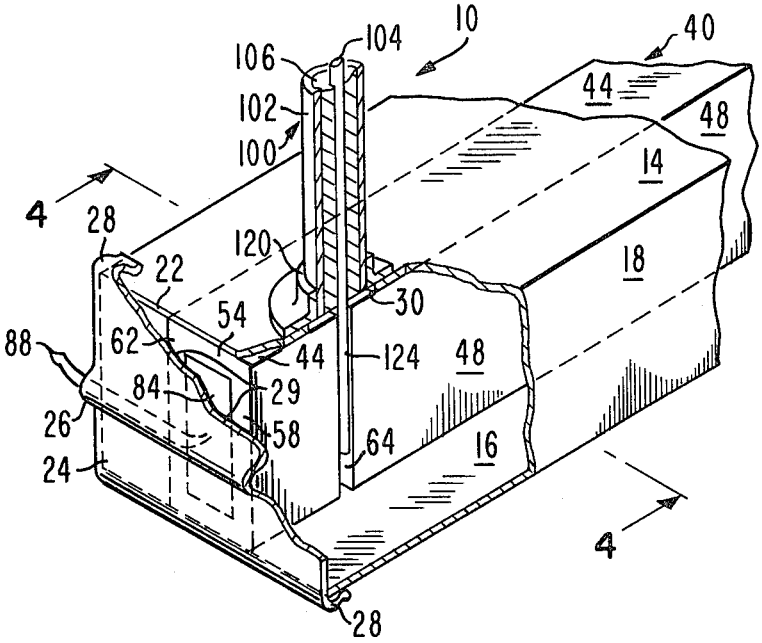
Figure 5:
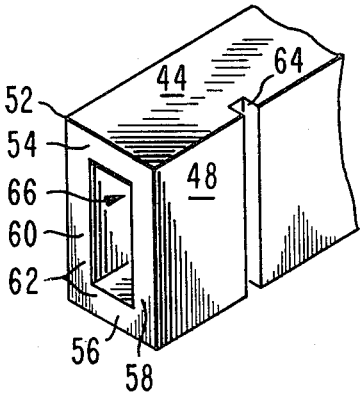
Figure 4:
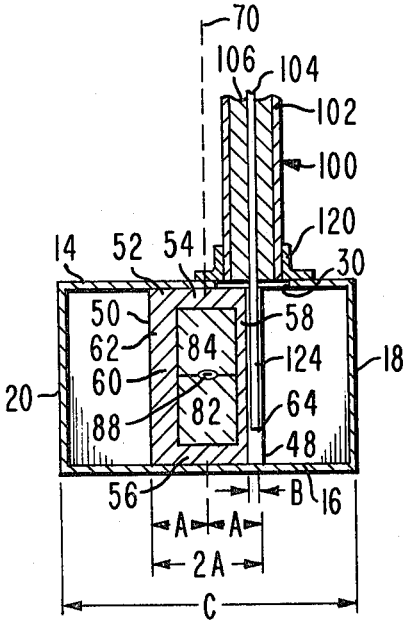

In the drawings:

FIG. 1 is a perspective view of a coupling structure in accordance with the invention for connecting a coaxial transmission line to a dielectrically loaded waveguide, FIG. 2 is another perspective view of the coupling structure of FIG. 1 with portions removed to more clearly illustrate specific details of the structure, FIG. 3 is a perspective, partially cross-section view of the coupling structure of FIG. 1 with a portion of the waveguide cut away, FIG. 4 is a cross-section of FIG. 3 taken along the line 4—4 in the direction indicated by the arrows, FIG. 5 illustrates a portion of a gyromagnetic toroid suitable for loading the waveguide.

A coupling structure 10 for coupling a coaxial transmission line 100 to a perpendicularly oriented, dielectrically loaded waveguide 12 is illustrated in FIG. 1. Coupling structure 10 relies on E-plane coupling within the waveguide 12 in which the desired signals propagate in a $TE_{10}$ mode. Now referring to FIG. 2, the rectangular waveguide 12 has first and second spaced apart parallel broad walls 14 and 16 and perpendicular thereto first and second parallel narrow walls 18 and 20 spaced apart by a distance C. The waveguide 12 is loaded by a longitudinally extending body 40 of dielectric material which contacts both broadwalls (14 and 16).

In this waveguide, the E-field is oriented perpendicular to the broad walls 14 and 16. The waveguide 12 has a first end 22 at which all four walls of the waveguide end in a common plane oriented perpendicular to the length of the waveguide. A short circuit 24 (FIG. 1) terminates waveguide 12 at end 22. Termination 24 is preferably held in place by an adhesive or glue 29 (FIG. 3) and by spring portions 28 of termination 24 which provide electrical continuity between termination 24 and waveguide walls 14 and 16. A bulge 26 in termination 24 is centered between and extends parallel to the broad walls 14 and 16 of the waveguide 12. This bulge accommodates a portion of the length of a set of control wires 88 which extend lengthwise down the waveguide 12 within dielectric body 40. The bulge 26 is oriented perpendicular to the E-field within the waveguide to minimize coupling between that E-field and the portions of the control wires 88 within the bulge.

The body 40 of dielectric material has a first wall surface 44 (FIG. 2) which is substantially parallel to and preferably in intimate contact with the broad wall 14 of waveguide 12 along the entire length of the body 40. Body 40 has a second wall surface 46 which is substantially parallel to and preferably in intimate contact with broad wall 16 along the entire length of the body 40. The body 40 has a pair of lateral wall surfaces 48 and 50 which are spaced from each other by a distance 2A. It is preferred, both for ease of manufacturing and for uniformity of loading of the waveguide 12, that wall surfaces 48 and 50 be planar and oriented perpendicular to the broad walls 14 and 16 of the waveguide 12; however, this is not a requirement and bodies 40 having other shapes may be used.

For symmetry reasons, it is preferred to center body 40 between the narrow walls 18 and 20.

When the waveguide structure is a gyromagnetic waveguide phase shifter, the dielectric body 40 comprises a toroid 52 of gyromagnetic material. The interior hollow 66 (FIG. 5) of the toroid 52 is substantially filled by a dielectric core 80 (FIG. 2) having first and second halves 82 and 84. The material comprising core 80 is preferably a fired ceramic which has a high dielectric constant. A set of control wires 88 for setting the magnetization of the gyromagnetic material extends lengthwise down the toroid 52 and is preferably disposed between the halves of core 80. The reference numerals 54, 56, 58 and 60 are used to refer to the walls of toroid 52 which have, as their outer surfaces, the surfaces 44, 46, 48 and 50, of body 40, respectively.

The coaxial transmission line 100 has an outer conductor 102, an inner conductor 104 and a dielectric material 106 therebetween. The coaxial transmission line 100 is preferably attached to the waveguide 12 by a connector 120.

Broad wall 14 of waveguide 12 has an aperture 30 (FIG. 2) therein for receiving an E-plane waveguide probe 124 which is preferably oriented perpendicular to waveguide broad wall 14 and which terminates coaxial transmission line 100. In FIG. 2, the dashed line 122 illustrates the outline on wall 14 of the area occupied by connector 120. If desired, the probe 124 may constitute a portion of the coaxial line's inner conductor which extends beyond the end of its outer conductor.

As is illustrated in FIGS. 2, 3, 4 and 5, a passageway or slot 64 for receiving the probe 124 extends into the body 40 from the lateral surface 48. Slot 64 is perpendicular to broad wall 14 of the waveguide 12, and preferably extends the full width of wall surface 48, but need not do so. Both slot 64 and aperture 30 are dimensioned to accommodate probe 124. This slot can be made by grinding the wall surface 48 with a shaped diamond wheel before the toroid is inserted into the waveguide. Slot 64 is illustrated as rectangular (FIG. 5) but need not have square corners where the side walls of the slot meet its back wall. The depth dimension of slot 64 preferably extends only part way through the lateral thickness of wall 58 of the gyromagnetic toroid 52 (FIG. 4). Slot 64 is made slightly deeper and just slightly wider than the diameter of the probe 124 so that probe 124 will be contained entirely within the boundaries of the body 40, and will automatically be positioned in the proper location during assembly. This positions the probe in a location where there will be sufficient field strength to provide effective coupling between the probe and the waveguide. If the probe were positioned laterally beyond the outer surface 48 of body 40, then inefficient coupling (high VSWR) would result because of the low field strength there.

During assembly, cement or potting material is placed in the slot 64 and probe 124 is pushed into it in order to (1) expel air from the slot, (2) provide mechanical integrity for the structure and (3) avoid any possibility of electrical variations due to shifting of the probe 124. A high breakdown voltage potting compound such as Dow Corning 3145 is used to avoid dielectric breakdown during high power operation. Dow Corning 3145is fluid enough to flow around the wire and fill the slot and yet viscous enough not to flow out of the slot.

Probe 124 is displaced laterally a substantial distance (greater than A/2 and preferably greater than 3A/4) from a center plane 70 of the body 40. Plane 70 bisects body 40 and is disposed parallel to the narrow walls 18 and 20 of waveguide 12.

The slot 64 is preferably positioned where a wave propagating in the waveguide from an E-plane probe 124 in the slot 64 toward the waveguide short circuit termination 24 and reflecting therefrom will return to the probe 124 essentially in phase with the signal on the probe 124. This position is determined for a frequency within the frequency band over which the coupling structure is designed to be effective. This frequency is often in the middle of the band. This probe location results in a standing wave between the probe and the termination 24. This standing wave has a minimal effect on the transmission of power between the coaxial transmission line and the waveguide for frequencies within the band.

In a waveguide whose propagation constant is the same in both directions, this essentially-in-phase position is $\frac{1}{4}$ loaded-waveguide wavelength from the short circuit termination 24 at a frequency in the designed frequency band. However, because of the presence of the magnetized gyromagnetic material the waveguide 12 is non-reciprocal and its propagation constants are functions of the magnitude and direction of the gyromagnetic material's magnetization (remanence) and the direction of propagation. The magnitude and direction of this remanence is changed each time the phase shift of the phase shifter is reset.

The in-phase return signal condition gives the broadest bandwidth coupling. If desired, the distance by which the probe is spaced from the short circuit termination can be changed to compensate for other conditions (such as probe 124 having a small diameter in order that it may be an extending portion of the center conductor of the coaxial transmission line).

In a preferred embodiment of this structure which is designed to operate in the 3.1 to 3.5 GHz band, the coaxial cable 100 is an RG-141 cable and the waveguide 12 is 0.55 inch (1.4 cm) high by 0.75 inch (1.9 cm) wide in internal cross-section with the garnet toroid 52 contacting the two (broad) walls which are 0.55 inch apart. The toroid 52 is 0.3 inch (0.76 cm) wide and centered between the narrow waveguide walls. The walls 54, 56, 58 and 60 of the toroid are each 0.09 inch (0.23 cm) thick. The interior hollow 66 of the toroid is 0.12 inch (0.30 cm) wide by 0.37 inch (0.94 cm) high. The toroid's height is slightly larger than the waveguide's interior height to make the toroid a tight fit in the waveguide. This tight fit assures good contact between the broad walls 14 and 16 of the waveguide and the top and bottom surfaces 44 and 46, respectively, of the toroid.

Prior to insertion of the toroid 52 into the waveguide 12, slot 64 is milled 0.05 inch (0.13 cm) deep into the wall 58 of the garnet toroid using a diamond cutter. The direct access of the cutter to the slot region greatly simplifies the problem of forming a probe passageway 124 in the hard brittle garnet material because, instead of being a hole which must be drilled, the passageway is a slot which can be milled using the same cutting techniques as are used for squaring the ends 62 of the toroid 52 and its upper and lower surfaces 44 and 46. Milling the slot 64 0.05 inch deep leaves wall 58 with a remaining thickness of about 0.04 inch (0.1 cm) at the back of the slot, thereby assuring continued structural integrity for the garnet toroid. The waveguide probe 124 is an extending portion of the inner conductor wire of the RG-141 cable and is 0.04 inch (0.10 cm) in diameter and extends to 0.12 inch (0.30 cm) from waveguide wall 16. Aperture 30 is about 0.25 inch (0.64 cm) in diameter.

The center line of the slot 64 is 0.3 inch (0.76 cm) from the end 62 of the garnet toroid. This positions the center line of the probe substantially 180° of round trip propagation phase shift from the end 62 of the toroid at 3.5 GHz at which frequency the wavelength in this loaded waveguide is about 1.1 inch (2.79 cm). The 180° of phase shift produced by reflection from the short circuit termination 24 combined with this approximately 180° propagation phase shift produces the desired essentially-in-phase condition between a signal on probe 124 and its reflection from termination 24 at a frequency within the 3.1 to 3.5 GHz frequency band.

With the specified parameters, the probe "edge" nearest to toroid center plane 70 is 0.10 inch (0.25 cm) from the center plane and the probe "edge" farthest from center plane 70 is 0.14 inch (0.36 cm) from the center plane 70. Surface 48 of wall 58 of body 40 is 0.15 inch (0.38 cm) from the center plane 70. Thus, physically the probe 124 extends from $\frac{2}{3}$ to 14/15 of the distance from center plane 70 to the outer surface 48 of the toroid 52. Physically, the electrical center of the probe is 4/5 of the way from center plane to outer edge of the toroid 52. That is, the probe is centered laterally about 80% off center in the body 40 (toroid 52). Because of the greater dielectric constant (~50) of the ceramic core 80 as compared to that of the gyromagnetic toroid (~15) the physical location of the probe 124 is electrically offset an even greater percentage of the distance from the center plane 70 to the wall surface 48.

This coupling technique is applicable to many waveguide configurations, but is particularly useful whenever the width 2A of the dielectric load is 4 or more times the probe's "width" B (diameter for a right cylindrical probe) (see FIG. 4). This allows the probe to be positioned in a slot 64 and still have its edge nearest to center plane 70 at least 50% of the way from center plane 70 to the dielectric body's lateral outer surface 48 on that side, i.e., A/2 or farther than A/2 from the center plane 70. The width of the dielectric load should be from 20% to 80% and preferably 30% to 60% of the waveguide's width. The preferred percentage varies with the dielectric constant of body 40.

Thus, this coupling structure differs substantially from prior art E-plane couplers in that the waveguide probe is positioned substantially off center within a body of dielectric material which (non-uniformly) loads the waveguide.

Under the specified conditions, a wave having a frequency in the range 3.1 to 3.5 GHz propagating down this waveguide will have about 90% of its energy within the confines of the dielectric body 40. Thus, the E-plane probe 124 is located within the waveguide in an asymmetric manner with respect to the field pattern of a wave traveling down this waveguide. Despite this highly asymmetric probe position, this coupling structure has been found to have a Voltage Standing Wave Ratio (VSWR) of less than 1.1 over the frequency band 3.1 GHz to 3.5 GHz, and over a wide range of phase shifter settings (the phase shifter setting has a slight effect on the VSWR because of the phase setting's effect on the waveguide's propagation constants). A VSWR of 1.1 corresponds to successful transmission of 99.77% of the power on the coaxial transmission line to the waveguide and vice versa. Since the VSWR is less than 1.1, more than 99.77% of the power is successfully transmitted. Thus, this coupling structure provides an excellent match between the coaxial transmission line 100 and the loaded waveguide 12 and is extremely effective at coupling the coaxial transmission line to the waveguide and does so without compromising the physical or electrical integrity of the waveguide system including the dielectric load.

Contrary to expectations, it has been found that the VSWR of this coupling structure is relatively insensitive to a lack of physical and electrical contact between the dielectric body 40 and the short circuit termination 24 of the waveguide. As a consequence, the thickness of adhesive or glue 29 which is used during assembly to permanently secure the end 62 of the dielectric body 40 to the short circuit termination 24 is not a critical factor in system performance. A glue or adhesive can be placed under a few of the spring fingers 28 to assure that termination 24 remains fixed to waveguide 12.

The in-line coupling structure which this invention replaces is similar to that disclosed in U.S. Pat. No. 3,758,886 to Landry et al. In the replaced in-line coupling structure the open U-shaped dielectric loading transformer has a plurality of steps in dielectric thickness to achieve the desired match. These steps make that transformer somewhat cumbersome and expensive to produce. Thus, the configuration of this inventive coupling structure is simpler and less expensive to produce in addition to allowing the waveguide to be shortened to the length of the gyromagnetic material thereby reducing the size and weight of other components of the phased array structure.

From a manufacturing point of view, this coupling structure is a significant improvement over the prior art inline coupler structure because of (1) its compact nature, (2) the fact that it is not an in-line structure, (3) the fact that the slot 64 can be machined from the outside of the garnet toroid 52 without drilling, (4) the dimensions of the slot 64 are such that good mechanical strength is retained in the garnet toroid 52, (5) the probe 124 is securely held within the slot 64 which provides it with mechanical protection, (6) the system performance is relatively insensitive to the permittivity ($\epsilon$) of the potting compound which secures the probe in the slot 64 and (7) this coupling structure is substantially less costly than the prior art in-line coaxial-transmission-line-to-loaded-waveguide coupling structure.

The relative insensitivity of coupling to the permittivity of the potting material simplifies the problem of selecting a potting compound which has the required characteristics of a high breakdown voltage and a viscosity which allows the potting compound to surround the probe 124 during assembly without running out of the slot 64. It also minimizes the problem of properly controlling potting compound dispensing during assembly, since normal quantity variations do not affect device operation.

What is claimed is:

1. A coax to waveguide coupler comprising:

a rectangular waveguide having first and second broad walls spaced apart by first and second narrower walls, said waveguide being dimensioned for operation over a selected frequency range;

a body of dielectric material disposed between said broad walls for loading said waveguide, said body positioned between the narrower walls of said waveguide, having a cross-sectional dimension substantially less than the width of said waveguide, and having first and second lateral walls generally parallel to said narrower walls of said waveguide;

a coaxial transmission line terminated at said first broad wall of said waveguide, said first broad wall of said waveguide having an aperture at said termination, said termination being adjacent said first lateral wall of said body;

a short circuit termination at one end of said rectangular waveguide;

a probe coupled to the center conductor of said coaxial transmission line;

said body having a slot along said first lateral wall adapted to receive said probe, and said probe extending through said aperture and being disposed in said slot.

2. The coupler recited in claim 1 wherein:

said body of dielectric material is rectangular in cross-section with said lateral walls perpendicular to said first and second broad walls.

3. The coupler recited in claim 1 wherein:

said body is centered between said narrow walls of said waveguide.

4. The coupler recited in claim 1 wherein:

said probe extends substantially perpendicular to said first broad wall of said waveguide.

5. The coupler recited in claim 1 wherein:

said waveguide and said body together comprise a gyromagnetic waveguide phase shifter;

said body comprises:

a substantially rectangular toroid of gyromagnetic material, and a core of dielectric material centered in the toroid; and there is at least one wire within said toroid.

6. The coupler recited in claim 5 wherein:

said first lateral wall of said toroid has a thickness dimension extending perpendicular to said narrow walls of said waveguide; and said slot extends no more than $\frac{2}{3}$ of the way through the thickness dimension of said first lateral wall.

7. The coupler recited in claim 1 wherein:

said slot is sufficiently deep so that said probe does not protrude from the boundaries of said body.

* * * * *